US006475018B1

(12) United States Patent
Huang

(10) Patent No.: US 6,475,018 B1
(45) Date of Patent: Nov. 5, 2002

(54) TERMINAL FOR ASSEMBLING WIRES OF DIFFERENT DIAMETERS

(76) Inventor: Yea Yen Huang, No. 12, Alley 70, Sec. 1, Chung Hua Road, Tocheng City, Taipei Hsien (TW)

( * ) Notice: Subject to any disclaimer, the term of this patent is extended or adjusted under 35 U.S.C. 154(b) by 0 days.

(21) Appl. No.: 09/865,716

(22) Filed: May 29, 2001

(51) Int. Cl.[7] ..... H01R 4/24
(52) U.S. Cl. ..... 439/397; 439/404
(58) Field of Search ..... 439/404, 405, 439/417, 660, 397, 401

(56) References Cited

U.S. PATENT DOCUMENTS 3,902,154 A * 8/1975 McKee ..... 439/401
3,937,549 A * 2/1976 Hughes ..... 439/401
4,046,446 A * 9/1977 Reavis, Jr. ..... 439/401
6,102,728 A * 8/2000 Shinchi ..... 439/397

* cited by examiner

*Primary Examiner*—Gary F. Paumen
(74) *Attorney, Agent, or Firm*—Troxell Law Office PLLC

(57) ABSTRACT

A terminal for assembling wires of different diameters, such as UBS or 1394 terminals. The terminal includes a base with piercing conductive pieces installed in the base. A buckling press is attached to the base and presses metal wires positioned so that conductive wires of different diameters in a predetermined range can be connected effectively.

1 Claim, 3 Drawing Sheets

TERMINAL FOR ASSEMBLING WIRES OF DIFFERENT DIAMETERS

BACKGROUND OF THE INVENTION

Computer, electronic devices and other related devices are developed continuously. Therefore, the data or instruction transmissions between different components are performed by wires so that connecting terminals are more and more important. To transfer data correctly, each pin of a terminal must be completely connected to each conductive metal wires of a cable. Therefore, how to connect pins of a terminal to metal wires of a cable rapidly and effectively has become a critical point in manufacturing terminals.

Since the function of the transmitting wire connected to a terminal is varied, the prior art that a terminal is connected to a plurality of wires with the same diameter is changed. Currently, a terminal is necessary to be connected with a plurality of wires with different diameters by pins, such as universal serial buses. In general, in that system, a terminal is connected to four wires (afterward, it will be developed to be connected to six or eight wires). Two wires are coarse, and the other two are slender. The two coarse wires are power wires (wire of electric number 24 to number 28 according to the current. The larger the number, the thinner the diameter). The wire for signal transmission is slender (wire of electric number 28 to 30). Therefore, the terminal of the wires must be connected to wires of different diameters. However, in order to have a preferred quality of connection, in the manufacturing of the terminal, different parts must be prepared, such as metal pins, and fixing press plates. The manufacturing process is thus prolonged. The parts can not be standardized so that the compatibility is low.

The various objects and advantages of the present invention will be more readily understood from the following detailed description when read in conjunction with the appended drawing.

SUMMARY OF THE INVENTION

Accordingly, the primary object of the present invention is to provide a terminal for assembling wires of different diameters, wherein a terminal can be assembled with conductive wires of different diameters, such as UBS or 1394 terminals. A base is placed in a terminal, and a piercing conductive piece can be installed in the base. A buckling press is used to be pressed as metal wires are positioned so that conductive wires of different diameters in a predetermined range can be connected effectively.

DETAILED DESCRIPTION OF THE PREFERRED EMBODIMENTS

Figure 1:
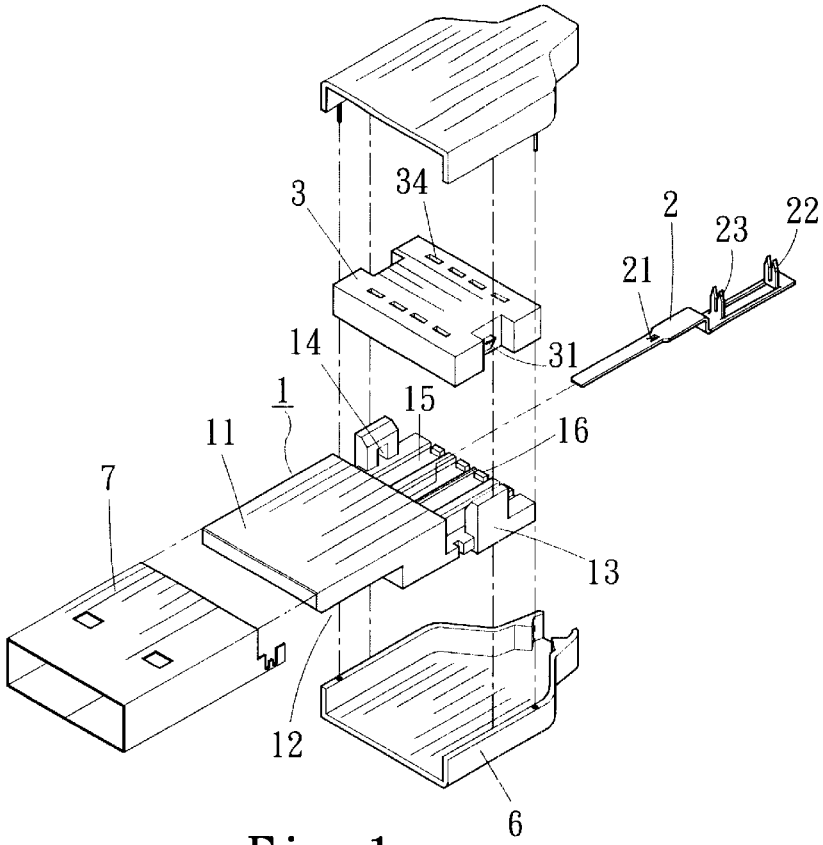
FIG. 1 is an exploded perspective view of the components of the present invention.
Figure 2B:
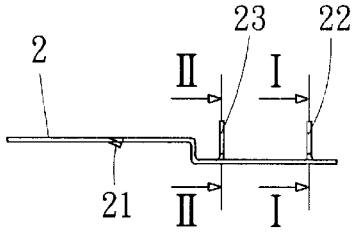
FIG. 2B is a side view of one of the piercing conductive pieces of FIG. 2A.
Figure 2A:
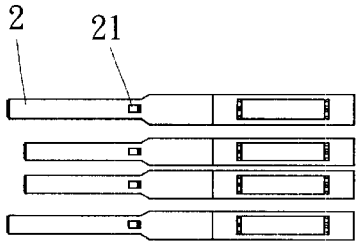
FIG. 2A is a bottom view of the piercing conductive pieces of the present invention.
Figure 2C:
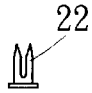
FIG. 2C is a cross-sectional view taken along line I—I of FIG. 2B.
Figure 2D:
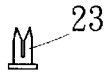
FIG. 2D is a cross-sectional view taken along line II—II of FIG. 2B.
Figure 3B:
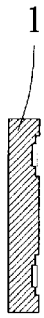
FIG. 3B is a cross-sectional view taken along line III—III of FIG. 3A.
Figure 3C:
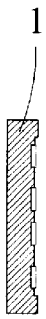
FIG. 3C is a cross-sectional view taken along line IV—IV of FIG. 3A.
Figure 3A:
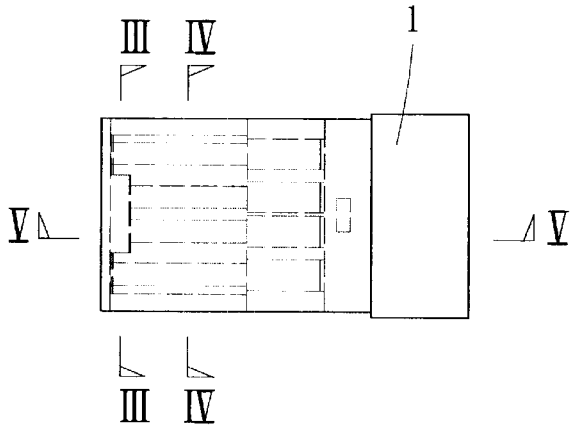
FIG. 3A is a bottom view of the base according to the present invention.
Figure 3D:
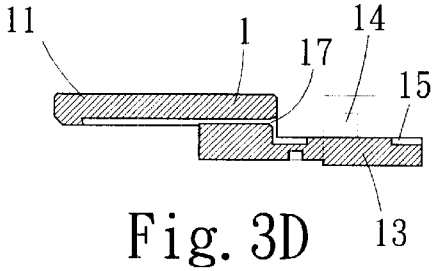
FIG. 3D is a cross-sectional view taken along line V—V of FIG. 3A.
Figure 4A:
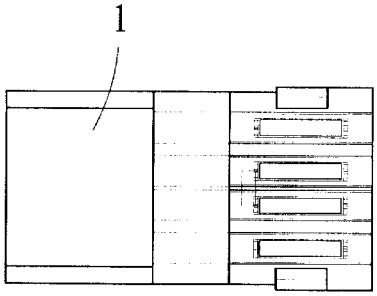
FIG. 4A is a top view of the base assembly of the present invention.
Figure 4B:
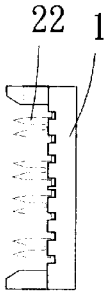
FIG. 4B is an end view of the base assembly of FIG. 4A.

Referring to FIGS. 1, 3 and 4, the present invention is suitable for terminals for assembling wires of different diameters. The present invention includes a base 1, piercing conductive piece 2, and a buckling press 3, etc. The base 1 has basically a rectangular shape. A front end thereof has an extending tongue 11. The lower side of the extending tongue 11 has an opened section 12, and the rear side thereof has a press section 13. The two sides of the press section 13 are installed with buckling groove 14. A recess is installed in the plane thereof. The distal end of the recess 15 is a stop 16. The recess 15 extends to the extending tongue 11 and then is formed with a penetrating positioning groove 17.

Referring to FIG. 2, the piercing conductive piece 2 of the present invention has a shape approximately matching to the recess 15 of the base 1 and the penetrating positioning groove 17, while the front section thereof has a stop block 21 and the rear section thereof has a large piercing rod 22 and a small piercing rod 23. The center of the large piercing rod 22 has a larger slot suitable to be penetrated and then connected to a metal wire with a larger diameter, while the small piercing rod has an opposite effect.

Figure 5:
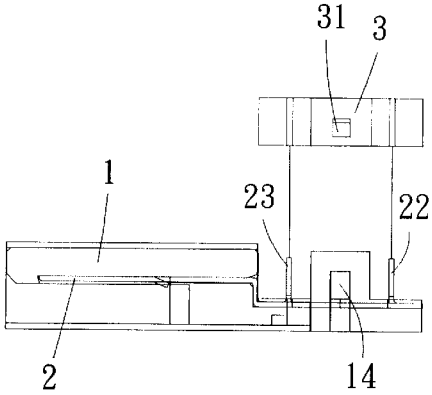
FIG. 5 is an exploded side view showing the base of the terminal having been placed with a piercing conductive piece and a buckling press pressed thereinto.

Referring to FIGS. 4 and 5, the front end of the piercing conductive piece 2 passes into the penetrating positioning groove 17 and then is buckled by the stop block 21 so that the front end of the piercing conductive piece 2 exposes out of the opening section 12 below the extending tongue 11 of the base 1 (for contacting and conduction as assembling with the male side). Moreover, the rear section thereof is placed into the recess 15. Thereby, the piercing conductive piece 2 is combined to the base 1.

Figure 6A:
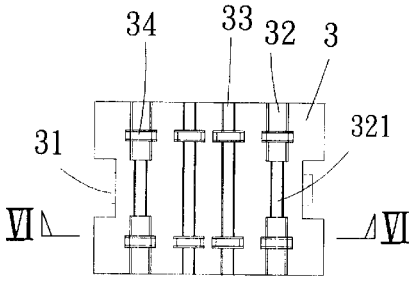
FIG. 6A is a bottom view of the buckling press of the present invention.
Figure 6B:
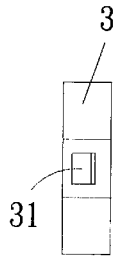
FIG. 6B is an end view of the buckling press of FIG. 6A.
Figure 6C:
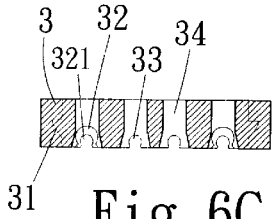
FIG. 6C is a cross-sectional view taken along line VI—VI of FIG. 6A.
Figure 7:
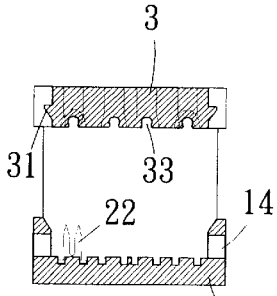
FIG. 7 is an exploded cross sectional view showing the base of the terminal having been placed with a piercing conductive piece and a buckling press pressed thereinto.
Figure 9:
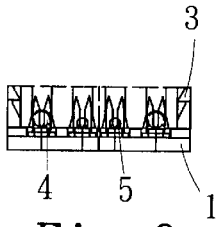
FIG. 9 is an assembled view of the terminal of the present invention.

With reference to FIGS. 5, 6, and 7, the buckling press 3 of the present invention has a shape similar to the press section 13 at the rear side of the base 1. Two sides thereof are installed with hooks 31 symmetrically to the buckling groove 14. The lower side of the buckling press 3 is installed with a plurality of large wire grooves 32 and a plurality of small wire grooves 33 which are equal in numbers and symmetrical to the recess 15 and piercing conductive piece 2. The middle section of the large wire groove 32 has small wire slot 321. The buckling press 3 is installed with through holes 34 with respect to the large piercing rod 22 and small piercing rod 23.

Figure 8:
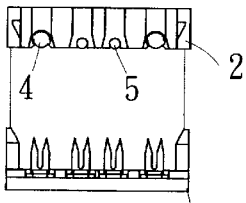
FIG. 8 is an exploded side view of the terminal of the present invention being coupled with a lead wire.

Referring to FIGS. 5, 7 and 8, in assembly, the metal conductive wires 4 and 5 of different diameters are placed in the large wire groove 32 and small wire groove 33 of the buckling press 3 (in general, the large metal conductive wire 4 is placed at outer side, and the slender one 5 is placed at the middle section). The larger metal conductive wire does not pass through the small piercing rod 23, but is stopped in front of the small piercing rod 23). After the wire is pressed into the base 1 so that the piercing rods 22 and 23 pierces through each metal conductive wires so as to conduct. Then, it is buckled and positioned by the buckling groove 14 and hook 31. Then, an inner casing 6 covers thereon.

Aforesaid terminal structure of the present invention can be assembled with slender metal conductive wires 5, while the two wires at the outer side are penetrated by the smaller piercing rod 23. If it is assembled with larger wires 4, it is only necessary to replace the buckling press 3. Thereby, the terminal structure of the present invention may be assembly by only slender wires, or only larger wires, or the mixing of the two.

Referring to FIG. 1, after assembling the terminal, in general, a front edge thereof is inserted into a frame 7 and then outer side of the inner casing 6 is screwedly fixed or is molded. These are well known in the prior art, and thus the detail will not be described herein.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A terminal for assembling wires of different diameters comprising:

a base having a rectangular shape; a front end thereof having an extending tongue; a lower side of the extending tongue having an open section and a rear side thereof having a press section, two sides of the press section having buckling grooves; a plurality of recesses formed in the press section, ends of the recesses forming a stop, each recess extending to the extending tongue and then having a penetrating positioning groove;

piercing conductive pieces having shapes approximately matching and installed in the recesses of the press section of the base and penetrating the positioning grooves, front sections of the pieces having stop blocks and rear sections thereof having a large piercing rod and a small piercing rod; front ends of the piercing conductive pieces passing into the penetrating positioning grooves and connected to the stop block so that the front ends of the piercing conductive pieces are exposed out of the opening section below the extending tongue of the base; rear sections of the piercing conductive pieces located in the recess whereby the piercing conductive pieces are combined to the base; and a buckling press having a shape similar to the press section of the base; two sides of the buckling press having hooks engaged with the buckling grooves; a lower side of the buckling press having plurality of large wire grooves and a plurality of small wire grooves which are equal in numbers and aligned with the recesses and piercing conductive pieces; middle sections of the large wire grooves having small wire slots; the buckling press having through holes to accommodate the large piercing rods and small piercing rods.

* * * * *